US009972977B2

(12) United States Patent
Miyawaki et al.

(10) Patent No.: US 9,972,977 B2
(45) Date of Patent: May 15, 2018

(54) SPARK PLUG FOR INTERNAL COMBUSTION ENGINE

(71) Applicant: DENSO CORPORATION, Kariya, Aichi-pref. (JP)

(72) Inventors: Aki Miyawaki, Nishio (JP); Atsushi Honda, Nishio (JP); Syoichi Takemoto, Nishio (JP); Akihiro Ando, Nishio (JP); Takanobu Aochi, Nishio (JP); Masamichi Shibata, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days. days.

(21) Appl. No.: 15/304,941

(22) PCT Filed: Apr. 15, 2015

(86) PCT No.: PCT/JP2015/061586
§ 371 (c)(1),
(2) Date: Oct. 18, 2016

(87) PCT Pub. No.: WO2015/159918
PCT Pub. Date: Oct. 22, 2015

(65) Prior Publication Data

US 2017/0194769 A1 Jul. 6, 2017

(30) Foreign Application Priority Data

Apr. 18, 2014 (JP) ..... 2014-086335

(51) Int. Cl.
*H01T 13/02* (2006.01)
*H01T 13/00* (2006.01)

(52) U.S. Cl.
CPC ..... *H01T 13/02* (2013.01); *H01T 13/00* (2013.01)

(58) Field of Classification Search
CPC ..... H01T 13/00; H01T 13/02
USPC ..... 313/144
See application file for complete search history.

(56) References Cited

U.S. PATENT DOCUMENTS 6,111,345 A * 8/2000 Shibata ..... F02P 13/00 313/140
2011/0254428 A1 10/2011 Kyuno et al.
2013/0134857 A1 5/2013 Shimamura et al.

* cited by examiner

*Primary Examiner* — Christopher Raabe
(74) *Attorney, Agent, or Firm* — Nixon & Vanderhye P.C.

(57) ABSTRACT

A spark plug 5 for an internal combustion engine includes a center electrode 1, an insulator 2, and a housing 3. The insulator 2 includes a distal end side exposed part and an insulator enlarged diameter part 21. The housing 3 includes a lateral electrode 32, an engaging part 33, and a crimping portion 35. A buffer member 4 that restrains the distal end side exposed part 20 by pressing a part of the distal end side exposed part 20 toward the center and a part of the inner peripheral surface of the lateral electrode 32 in a radial direction at a distal end side of the engaging part 33 is disposed at a base end side of the gas pocket 230.

8 Claims, 8 Drawing Sheets

(COMPARATIVE EXAMPLE)

(EMBODIMENT)

SPARK PLUG FOR INTERNAL COMBUSTION ENGINE

This application is the U.S. national phase of International Application No. PCT/JP2015/061586 filed 15 Apr. 2015, which designated the U.S. and claims priority to JP Patent Application No. 2014-086335 filed 18 Apr. 2014, the entire contents of each of which are hereby incorporated by reference.

TECHNICAL FIELD

The present invention relates to a spark plug for an internal combustion engine.

BACKGROUND ART

A spark plug that ignites an air mixture by generating a spark discharge by applying a high voltage in a discharge gap disposed between a center electrode and a ground electrode, the center electrode and the ground electrode are disposed with an insulator therebetween, for an ignition of an internal combustion engine is widely used for a spark plug for an internal combustion engine.

In recent years, reduction of a diameter of a spark plug is desired for increasing the degree of freedom of design of an engine, to attempt cooling performance improvement of the engine, or to increase the size of an intake valve for increasing an intake air amount.

A spark plug includes a ceramic insulator having a channel extending in an axial direction, a center electrode inserted into a distal end side of the pore, and a cylindrical main fitting disposed on an outer periphery of the insulator is disclosed in Patent Document 1. The insulator includes a long leg portion located at a distal end portion thereof, and a tapered portion extending from a rear end of the long leg portion towards a rear end side in the axial direction of which a diameter increases as it reaches toward the rear end side in the axial direction. The main fitting includes a stepped portion that protrudes radially inward and has an engaging surface where the tapered portion is engaged directly or indirectly, and a threaded portion located on an outer peripheral side of the stepped portion and screwed into a mounting hole of a combustion device.

Then, stress concentration to a boundary portion between the long leg portion and the tapered portion is reduced by setting a screw diameter of the threaded portion to M12 or less, and a relationship between a longitudinal area of the insulator and a longitudinal area of the main fitting at a predetermined position in predetermined range, thereby suppressing cracking of the insulator due to thermal shock from occurring.

PRIOR ART

Patent Document

[Patent Document 1] Japanese Patent Application Laid-Open Publication No. 2013-114762

DISCLOSURE OF THE INVENTION

Problems to be Solved by the Invention

When abnormal combustion of the internal combustion engine such as a pre-ignition or knocking occurs, a supersonic shock wave is produced by sudden pressure changes, and may be propagated to the spark plug.

At this time, the long leg portion of the insulator vibrates at a position to which an enlarged diameter portion provided in the insulator of the spark plug is crimped by the housing as a fixed end and a distal end side of the center electrode as a free end, thus the stress concentration may be caused at a boundary between the enlarged diameter portion and the long leg portion crimped and fixed by the housing so that there is a possibility of causing cracking of the insulator.

The present invention has been made in light of the problems set forth above and has as its object to provide a spark plug for an internal combustion engine having excellent durability that reduces a degree of vibration of an insulator even when a strong shock wave is generated in a combustion chamber due to abnormal combustion such as pre-ignition or knocking so that the insulator is prevented from cracking.

Means for Solving the Problems

In a spark plug for an internal combustion engine according to a first aspect, the spark plug is used for igniting a mixture of fuel and air introduced into a combustion chamber of an internal combustion engine, and includes at least a center electrode extending in a shaft-like shape, a cylindrical insulator supporting the center electrode, and a tubular housing accommodating and supporting the insulator. A side of the spark plug to be attached to the internal combustion engine is referred to as a distal end side, and a side opposite in an axial direction is referred to as a base end side. The insulator at least includes a distal end side exposed part exposed to the combustion chamber and an insulator enlarged diameter part of which a diameter of a part of a base end side of the distal end side exposed part is expanded radially outwards. The housing includes a cylindrical lateral electrode facing the combustion chamber, an engaging part of which a part of an inner peripheral surface of the lateral electrode projecting toward a center contacts directly or indirectly with a distal end side of the insulator enlarged diameter part, and a crimping portion for pressing the insulator in an axial direction via a sealing member disposed on a base end side of the insulator enlarged diameter part. A gas pocket of which a distal end side communicates with the combustion chamber is partitioned by a surface of the distal end side exposed part and the inner peripheral surface of the lateral electrode, and is closed by the engaging part and the enlarged diameter part, and a buffer member that restrains the distal end side exposed part by pressing a part of the distal end side exposed part toward the center and a part of the inner peripheral surface of the lateral electrode in a radial direction at a distal end side of the engaging part is disposed at a base end side of the gas pocket.

According to the present invention, even when high pressure shock waves are generated due to some kind of abnormal combustion such as a pre-ignition or knocking, and high frequency vibration acts on the distal end side exposed part, since the buffer member restrains a part of the distal end side exposed part at the distal end side of the engaging part, the stress concentration to the diameter changing part where the insulator enlarged diameter part supported by the engaging part switches to the distal end side exposed part can be avoided.

As a result, a spark plug for an internal combustion engine having excellent durability that enables prevention of breakage of an insulator by an extremely simple structure can be achieved.

MODE FOR CARRYING OUT THE INVENTION

Figure 1:
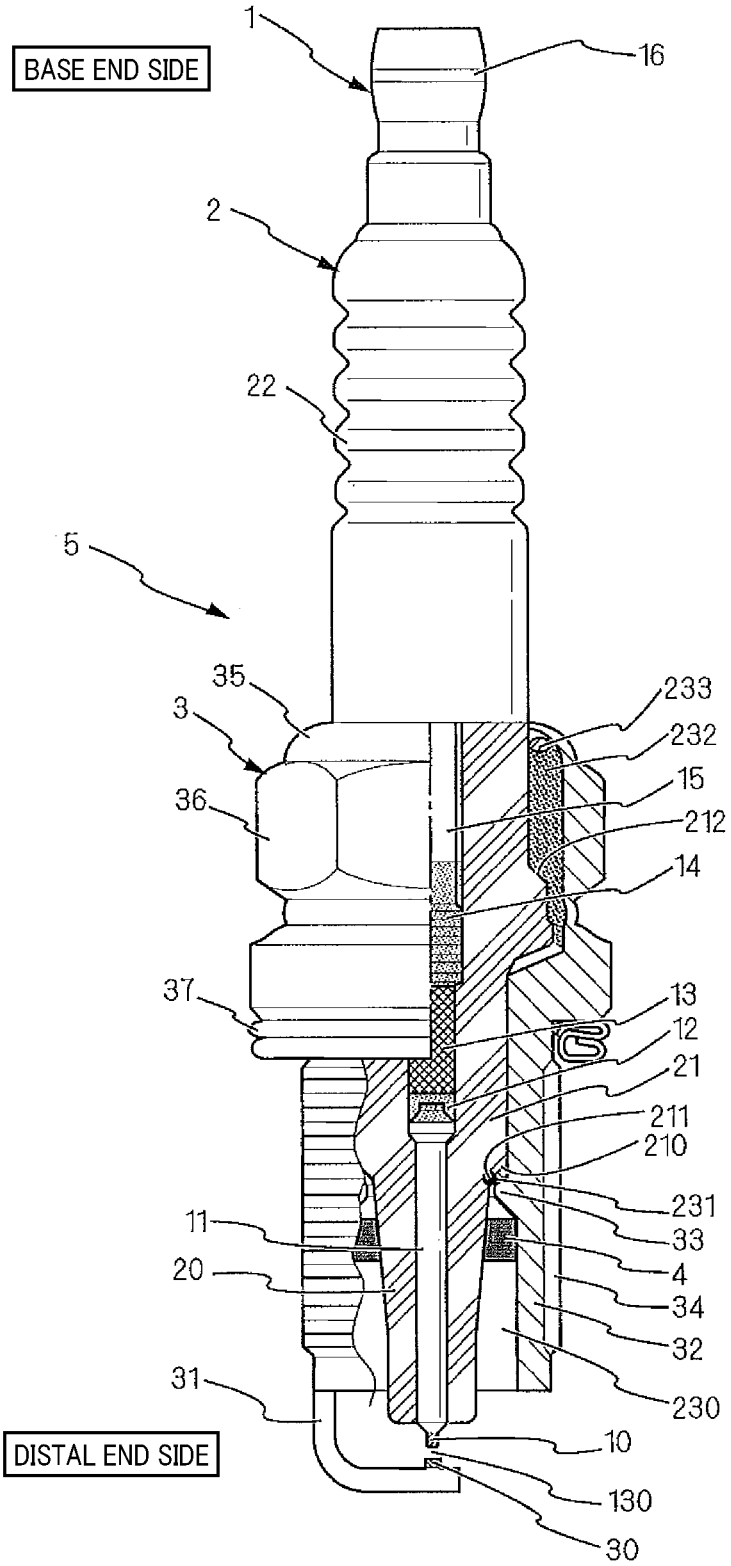
FIG. 1 shows a partial sectional view of a spark plug for an internal combustion engine according to a first embodiment of the present invention.

An outline of a spark plug 5 for an internal combustion engine (hereinafter, simply referred to as a spark plug 5) according to a first embodiment of the present invention will be explained with reference to FIG. 1 and FIG. 2A.

In the present embodiment, a side of the spark plug 5 to be attached to an internal combustion engine 6 is referred to as a distal end side, and a side opposite in an axial direction is referred to as a base end side for the description.

The present invention is for preventing an insulator 2 from being damaged even when shock waves are generated by abnormal combustion such as a pre-ignition, knocking, or detonation occurs, by reducing a degree of vibration W of a distal end side exposed part 20 by disposing a buffer member 4, which will be described later, at a predetermined position in addition to a conventional spark plug.

The spark plug 5 is constituted by including a center electrode 1, an insulator 2, a housing 3, and a buffer member 4, which is an essential part of the present invention.

The spark plug 5 of the present embodiment to which the present invention is applied is a so-called spark discharge type spark plug that disposes a ground electrode discharge part 30 that opposes a center electrode discharge part 10 disposed at a distal end of the center electrode 1 with a predetermined discharge space 130 therebetween, by extending a distal end of the housing 3, and arc discharge is generated by applying a high voltage between the center electrode discharge part 10 and a ground electrode discharge part 30, whereby an air-fuel mixture is ignited.

The center electrode 1 is formed into a long shaft-like shape in an axial direction.

The center electrode 1 of the present embodiment is constituted by the center electrode discharge part 10 that is exposed to a combustion chamber 60, a center electrode high thermal conductive part 11, conductive adhesive layers 12, 14, a noise-preventing resistor 13, a center electrode axial intermediate shaft part 15, and a center electrode terminal part 16.

A known heat-resistant noble metal material such as Pt, or Ir is used for the center electrode discharge part 10.

A known heat-resistant metal material such as Fe, Ni, or alloys thereof is used for the center electrode high thermal conductive part 11, and a known metal material having high thermal conductivity such as Cu is used for an inside thereof.

A mixture of glass powder and copper, iron, or metal powder alloys thereof is used for the conductive adhesive layers 12, 14, and after being filled in predetermined positions in the insulator 2, the mixture is compressed, heated, and melted.

The conductive adhesive layer 12 seals and fixes a base end side of the center electrode high thermal conductive part 11, and electrically conducts between the center electrode high thermal conductive part 11 and the noise-preventing resistor 13.

The conductive adhesive layer 14 seals and fixes a base end side and a distal end of the center electrode axial intermediate shaft part of the noise-preventing resistor 13, and conducts between the noise-preventing resistor 13 and the center electrode axial intermediate shaft part 15.

The noise-preventing resistor 13 is configured by being formed of a glass powder including one or more selected from any of a $B_2O_3$-$SiO_2$ system, BaO—$SiO_2$-$B_2O_3$ system, ZnO—$B_2O_3$-$SiO_2$ system, BaO—CaO—$B_2O_3$-$SiO_2$ system, $Na_2O$—$SiO_2$-$B_2O_3$ system, $K_2O$—$SiO_2$-$B_2O_3$ system, $Al_2O_3$-$B_2O_3$-$SiO_2$ system, BaO—$B_2O_3$ system, $Bi_2O$—$B_2O_3$ system, and $SiO_2$-MgO—$Al_2O_3$ system; a conductive powder such as carbon, and an aggregate formed of an insulating material including one or more selected from any of $Al_2O_3$, $SiO_2$, SiC, $Si_3N_4$, and $ZrO_2$, and after being filled in the insulator 2 and compressed, it is heated and melted.

The insulator 2 is made of a known heat-resistant insulating ceramic material such as high purity alumina, formed in a cylindrical shape, and the center electrode 1 is inserted inside thereof to be held.

In the present embodiment, the insulator 2 is constituted by a distal end side exposed part 20, an insulator enlarged diameter part 21, and an insulator head part 22.

The insulator enlarged diameter part 21 is formed so that a portion of the insulator 2 projecting toward an outer peripheral direction and a diameter thereof is larger than other portions.

A distal-end-side inclined surface 210 that inclines such that a diameter thereof is reduced as it reaches toward the distal end side is disposed on the insulator enlarged diameter part 21.

The distal-end-side inclined surface 210 is in contact directly or indirectly with an engaging part 33 formed so as to project toward a center from an inner peripheral surface of the housing 3.

In the present embodiment, a metal seal ring 231 is disposed between the distal-end-side inclined surface 210 and the engaging part 33, and airtightness between the insulator enlarged diameter part 21 and the engaging part 33 is secured.

A base-end-side inclined surface 212 of which a diameter is reduced as it reaches toward the base end side is formed on the base end side of the insulator enlarged diameter part 21.

A known powder sealing member 232 such as talc, a seal ring 233, or the like are disposed on the base end side of the base-end-side inclined surface 212, and airtightness between the insulator 2 and the housing 3 is secured by disposing a crimping portion 35 on the base end side of the housing 3 and by acting an axial forces between the crimping portion 35 and the engaging part 33.

A gas pocket 230 of which a base end side is closed by the engaging part 33 and the enlarged diameter part 21, and a distal end side is communicated with the combustion chamber 60 of the internal combustion engine 6 is partitioned between the distal end side exposed part 20 that the insulator 2 is exposed from the engaging part 33 and a cylindrical lateral electrode 32 that extends towards the distal end side of the engaging part 33.

The length L1 from a diameter changing part 211, where the distal-end-side inclined surface 210 switches to the distal end side exposed part 20 of the insulator 2, to the distal end of the insulator 2 is appropriately set according to a required heat value.

Known metal materials such as Fe, Ni, alloys thereof, carbon steel, or stainless steel is used for the housing 3, and the housing 3 is formed in a cylindrical shape accommodating and supporting the insulator 2 therein.

The crimping portion 35 is disposed at the base end of the housing 3, and applies compressive force in the axial direction to the insulator enlarged diameter part 21 of the insulator 2 together with the engaging part 33, thereby airtightness between the insulator 2 and the housing 3 is secured.

A threaded portion 34 for fixing the spark plug 5 to an engine head 61 is formed on a distal end side outer circumference of the housing 3, and a hexagonal portion 36 for fixing and fastening the threaded portion 34 is formed on a base end side outer circumference of the housing 3.

In the present embodiment, an L-shaped ground electrode 31 extending toward the distal end side of the housing 3 is provided, and the ground electrode discharge part 30 is disposed at the distal end of the ground electrode 31 in a position opposed to the center electrode discharge part 10 with the predetermined discharge space 130.

A known heat-resistant noble metal such as Pt, or Ir is used for the ground electrode discharge part 30.

The buffer member 4, which is the essential part of the present invention, is disposed at the distal end side of the engaging part 33 so as to cover a part of the surface of the distal end side exposed part 20 while contacting closely with a part of an inner peripheral surface of the lateral electrode 32.

The buffer member 4 is formed in an annular shape by a heat-resistant resin material which is heat-resistant to 100 degrees C. or more.

The buffer member 4 is disposed at the base end side of the gas pocket 230 which communicates with the combustion chamber 60, and since a surface of a distal end side faces the gas pocket 230, it is exposed to high temperature flame in a combustion stroke.

However, since a cooling water passage (not shown) is formed in the engine head 61 to which the housing 3 is fixed by the threaded portion 34, it is cooled by cooling water with the water temperature of 80 degrees C. or below, thereby the heat is radiated to the engine head 61 via the lateral electrode 32 and the threaded portion 34, thus the buffer member 4 will not be heated to 100 degrees C. or more for a long period of time.

Further, the buffer member 4 is also a ductile material having a ductility of Young's modulus of 0.1 to 20 GPa.

By using the ductile material for the buffer member 4, it can be elastically pressed without causing an excessive load on the distal end side exposed part 20 and thereby suppress a vibration of the distal end side exposed part 20 from occurring.

Further, by using the ductile member having the Young's modulus in the above range, the buffer member 4 itself becomes difficult to plastically deform.

The buffer member 4, specifically, for example, can be formed by selecting any one of fluorine-based resins, epoxy resins, silicone resins, polyamides, or polyimides.

Figure 6:
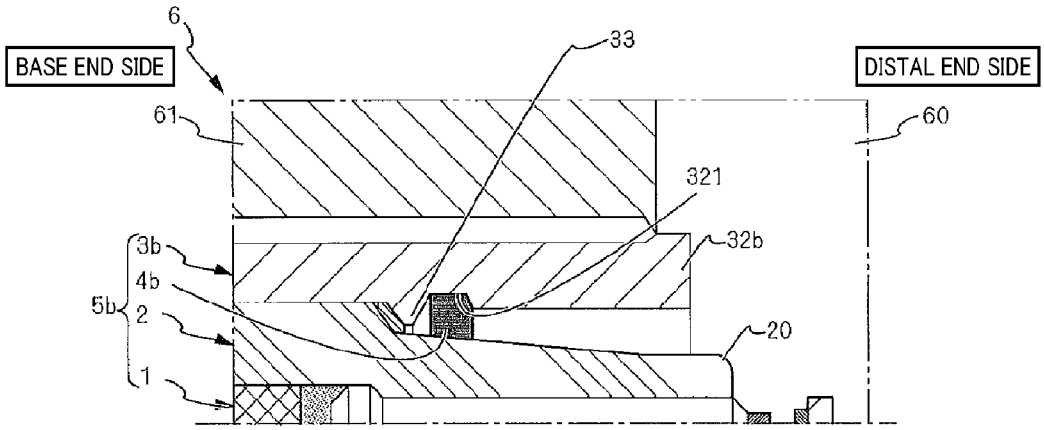
FIG. 6 shows an enlarged longitudinal sectional view of a principal part of another modification of the spark plug in the first embodiment of the present invention.

Incidentally, when using a material with low adhesive property with respect to the insulator 2 and the housing 3 formed of the fluorine-based resins or the like, in order to prevent the buffer member 4 from detaching, it is desirable to adopt a configuration of a spark plug 5*b* described later as a modification 2 with reference to FIG. 6.

Figure 2A:
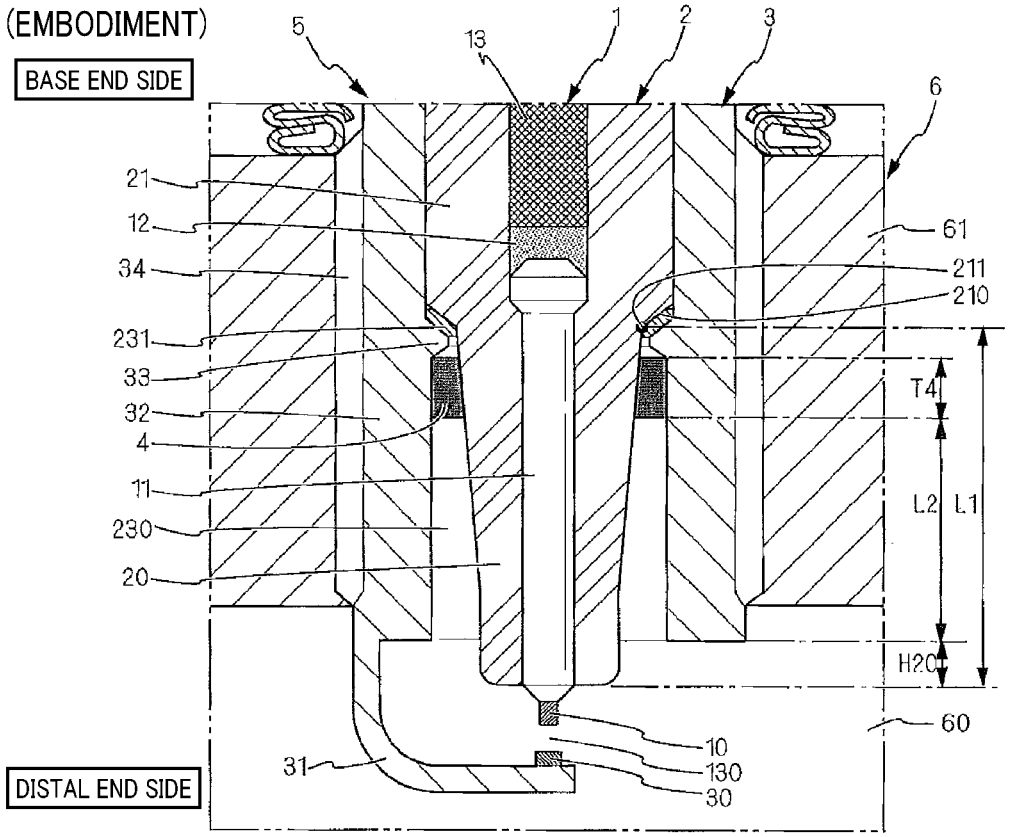
FIG. 2A shows an enlarged longitudinal sectional view of a principal part of the spark plug shown in FIG. 1.

In the present embodiment, as shown in FIG. 2A, the buffer member 4 is formed in the annular shape with a trapezoidal cross section in advance so as to cover the entire periphery of the part of the outer peripheral surface of the distal exposed part 20 of the insulator 2, and is inserted from the distal end side of the spark plug 5 and press-fitted thereto.

As a result, the buffer member 4 elastically presses the outer peripheral surface of the distal end side exposed part 20 toward the center at the distal end side of the engaging part 33, and elastically presses the inner circumferential surface of the lateral electrode 32 radially outwards.

Furthermore, the thickness T4 of the buffer member 4 is set so that the length L2 of the gas pocket 230 formed on the distal end side thereof to be at least 5 mm or more.

The thickness T4 of the buffer member 4 and the length L2 of the gas pocket 230 can be appropriately adjusted according to the heat value that conforms combustion characteristics of the internal combustion engine 6.

Further, the protruding length H20 of the distal end side exposed part 20 to the combustion chamber 60 may be appropriately changed in consideration of smoldering, pre-ignition, or the like.

The internal combustion engine 6 is a known internal combustion engine, and the combustion chamber 60 is partitioned by a cylinder, a piston slidably accommodated in the cylinder (both are not shown) and the engine head 61.

Although not shown in detail, the engine head 61 is provided with an intake port communicating with the combustion chamber 60, an intake valve for opening and closing the intake port, an exhaust port communicating with the combustion chamber 60, an exhaust valve for opening and closing the exhaust port, a fuel injection device for introducing fuel into the combustion chamber 60, and the spark plug 5 for igniting a mixture of fuel and air introduced in the combustion chamber 60.

Figure 2B:
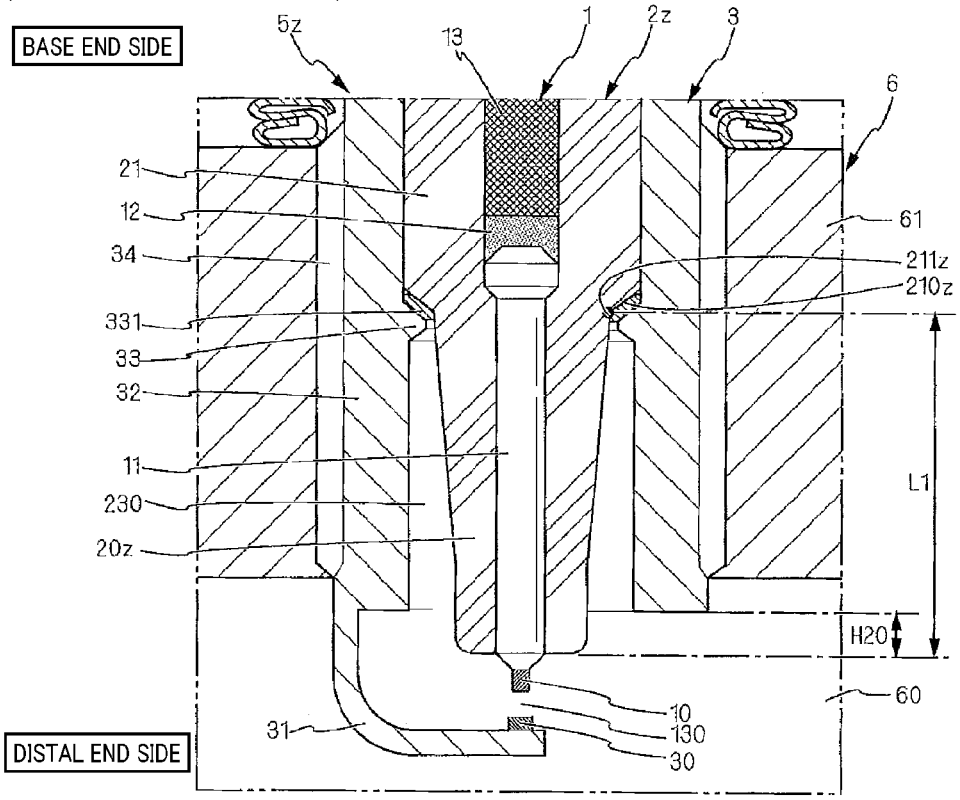
FIG. 2B shows an enlarged longitudinal sectional view of a principal part of a conventional spark plug as a comparative example.

On the other hand, in a conventional spark plug 5*z* shown in FIG. 2B as a comparative example is not provided with a buffer member 4 that is an essential part of the present invention.

In an insulator 2*z*, although a distal end side inclined surface 210*z* is in a state of being restrained by receiving an axial force $F_{AX}$ from an engaging part 33 and a crimping portion 35 at a base end side of the engaging part 33, a distal end side exposed part 20*z* that the insulator 2*z* is exposed from the engaging part 33 is not in any way restrained.

The rest of the configuration is exactly the same as the above-described embodiment, and a description thereof will be omitted, giving the same reference numerals.

Figure 3A:
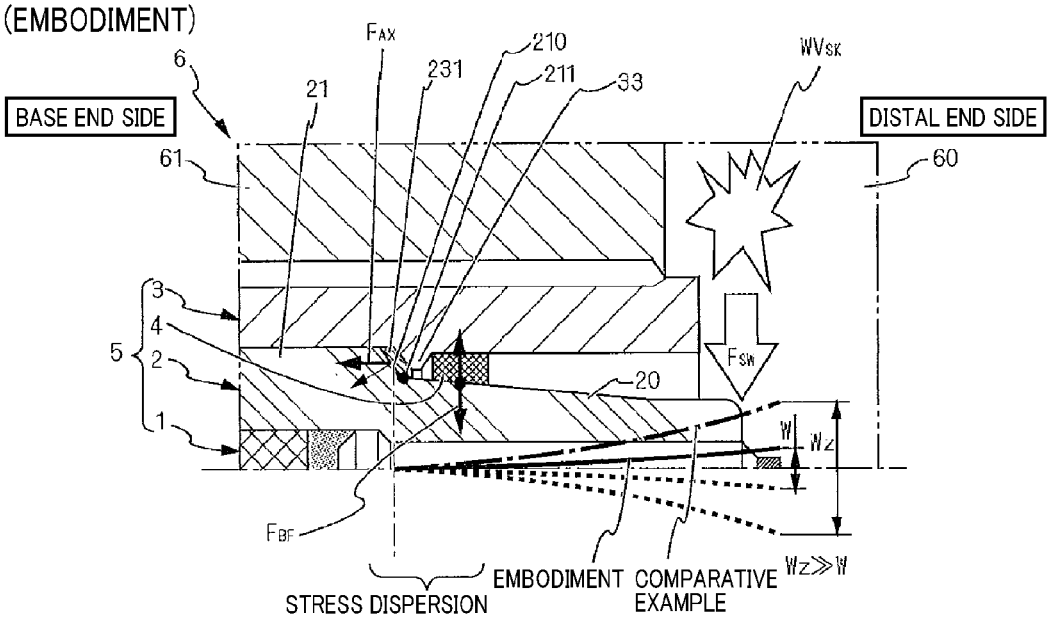
FIG. 3A shows an enlarged longitudinal sectional view of a principal part for explaining an effect of the present invention.
Figure 3B:
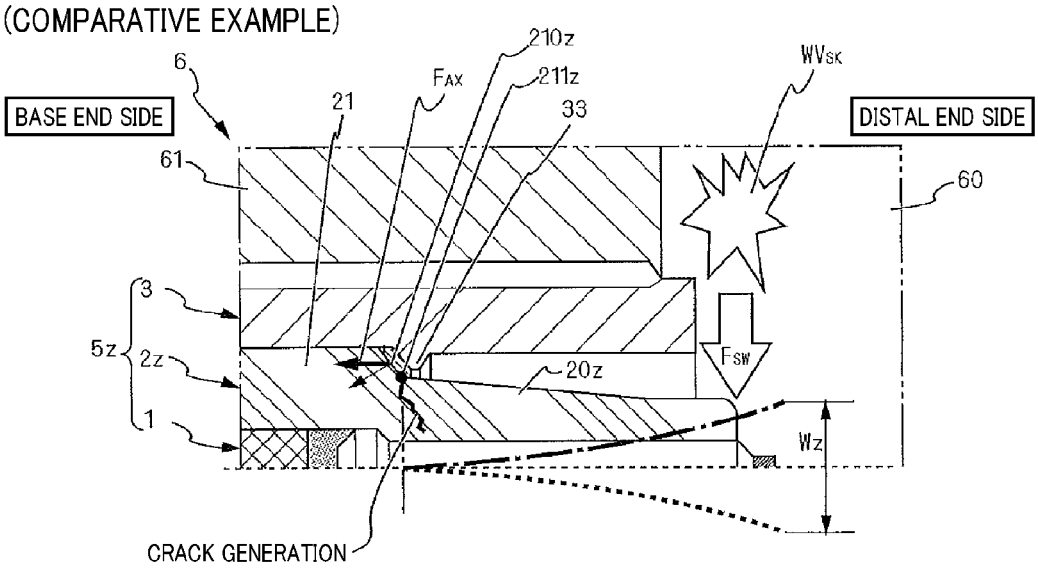
FIG. 3B shows an enlarged longitudinal sectional view of a principal part for explaining a problem in the comparative example.

Effects of the present invention and problems of the comparative example will be described with reference to FIG. 3A and FIG. 3B.

When abnormal combustion such as pre-ignition, knocking, or detonation occurs, a shock wave $WV_{SK}$ of high pressure $F_{SW}$ propagated at a speed greater than the speed of sound may occur.

The insulators 2 of the both spark plug 5 of the present invention and the conventional spark plug 5*z* shown as the comparative example are fixed by the axial force $F_{AX}$ acting on the insulator enlarged diameter part 21 which is sandwiched between the engaging part 33 and the crimping portion 35.

In the present invention, a certain range (corresponding to the thickness T4 of the buffer member 4) of the distal end side exposed part 20 exposed to the gas pocket 230 from the engaging part 33 is restrained while receiving a pressing force acting in the radial direction from the buffer member 4 disposed at the distal end side of the engaging part 33.

On the other hand, in the conventional spark plug 5*z*, no restraining force is acting on the distal end side of the engaging part 33 at all.

Incidentally, it is considered that the natural frequency of the distal end side exposed part 20 is proportional to a sectional area thereof, and is inversely proportional to the square of the length L1 from the diameter changing part 211 to the distal end of the insulator 2.

When the shock wave $WV_{SK}$ generated by abnormal combustion is transmitted to the distal end of the spark plug 5 or the spark plug 5*z* of the comparative examples in such a state, there is a possibility in the comparative example that the vibration (a degree of vibration Wz) may occur with a diameter changing part 211*z* between the insulator enlarged diameter part 21 fixed by the axial force from the engaging part 33 and the distal end side exposed part 20*z* that is in an open state as a fixed end, and the distal end where the center electrode discharge part 10 is exposed as a free end.

As a result, when a certain level or more of shockwave pressure $F_{SW}$ is applied, stress concentration occurs in the diameter change part 2112, thus cracks are generated in the insulator 2*z*.

On the other hand, in the present invention, since the buffer member 4 that restrains the distal end side exposed part 20 is arranged at the distal end side of the engaging part 33 in addition to the distal end side inclined surface 210 being pressed in the axial direction by the engaging part 33, even when the shock wave $WV_{SK}$ is generated by some kind of abnormal combustion and the distal end of the distal end side exposed part 20 receives the shock wave pressure $F_{SW}$, a restraining force $F_{BF}$ in a direction of suppressing the vibration degree W from the buffer member 4 will act.

Therefore, the degree of vibration W of the distal end side exposed part 20 becomes a lot smaller as compared to a degree of vibration Wz of the comparative example, thereby no stress concentration will be applied to the diameter change part 211, thus the breakage of the insulator 2 can be prevented from occurring.

Results of experiments conducted in order to confirm the effects of the present invention will be described with reference to FIG. 4. The spark plug 5 shown in FIG. 2A is used as an example for the present invention, and the spark plug 5*z* shown in FIG. 2B is used as a comparative example.

Figure 4:
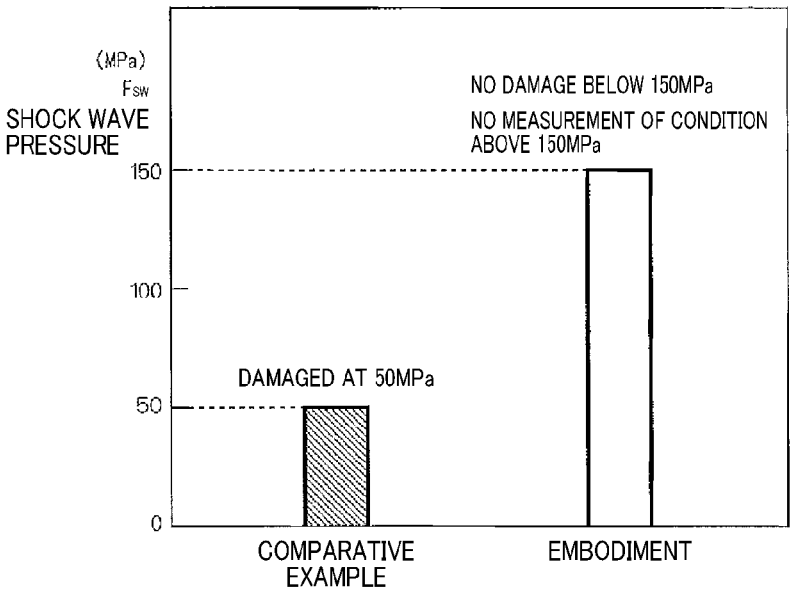
FIG. 4 shows a characteristic diagram of the effect of the present invention together with the comparative example.

When the spark plug 5 of the present invention and the conventional spark plug 5*z* are disposed to a pressure vessel that imitates a combustion chamber and the shock waves are applied thereto, cracks may be generated in the insulator 2*z* when the shock wave pressure $F_{SW}$ exceeds 50 MPa in the comparative example, as shown in FIG. 4.

On the other hand, in the embodiment of the present invention, no cracks are generated at all in the insulator 2 even when the shock wave pressure $F_{SW}$ is increased to 150 MPa.

As a matter of convenience of the device, experiments for the shock wave pressures $F_{SW}$ greater than 150 MPa cannot be performed, however, according to the present invention, it has been found that it is possible to achieve increase of durability to withstand at least three times or more shock-wave pressure $F_{SW}$ compared with the conventional spark plug 5*zo*.

Moreover, in the present invention, it is possible to achieve a dramatically improved durability by an extremely simple method of disposing the buffer member 4 at a predetermined position of the conventional spark plug 5*z*.

Figure 5:
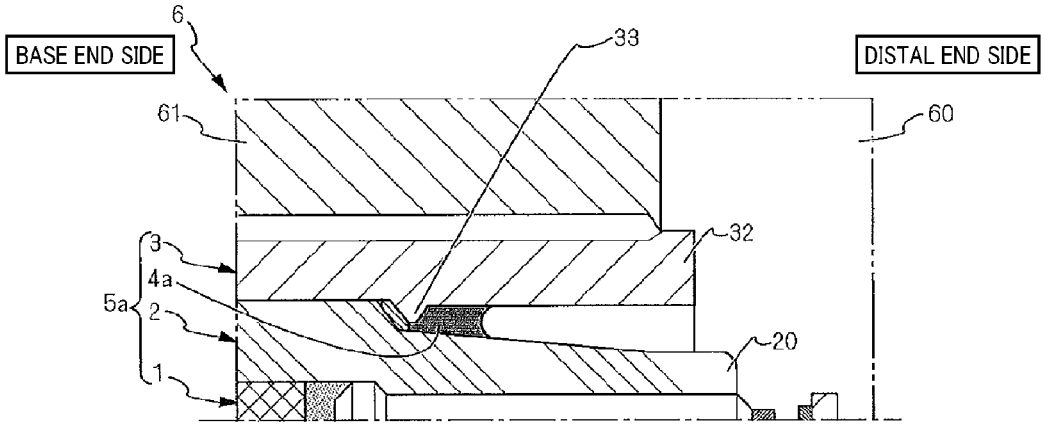
FIG. 5 shows an enlarged longitudinal sectional view of a principal part of a modification of the spark plug in the first embodiment of the present invention.

A modification 5*a* of the spark plug according to the first embodiment of the present invention will be described with reference to FIG. 5.

Although the present modification 5*a* has basically the same configuration as in the above embodiment, the buffer member 4 is not formed in the annular shape in advance and is not disposed by press-fitting or the like unlike the above embodiment, but it is different in a point that the buffer member 4*a* is disposed at a predetermined position by injecting a liquid resin member into a base end side of the gas pocket 230 and solidifying the liquid resin member.

According to the present embodiment, it is possible to improve the durability of the existing spark plug in a very simple method of injecting the resin in addition to the same effects as those of the above embodiment.

A material selected from any one of fluorine-based resins, epoxy resins, silicone resins, polyamides, or polyimides can be appropriately employed for the resin constituting the buffer member 4*a*.

Depending on the properties of a resin, it may be cured by drying or a chemical reaction after filling a liquid resin in a predetermined position, or it may be solidified by cooling after filling a heat-molten thermoplastic resin in a predetermined position, or it may be cured by heating after filling a thermosetting resin in a predetermined position.

In the present modification, since it is possible to fill the liquid resin throughout the gap between the surface of the engaging part 33 and the distal end side exposed part 20, improved airtightness between the insulator 2 and the housing 3 can also be achieved.

Another modification 5*b* of the spark plug according to the first embodiment of the present invention will be described with reference to FIG. 6.

The present embodiment is different in a point that a groove portion 321 is formed by depressing a part of the inner peripheral surface of the lateral electrode 32*b* disposed on the distal end side of the housing 3*b*, and a part of a buffer member 4*b* is disposed in the groove portion 321.

In the present modification, the buffer member 4*b* may be formed in the annular shape in advance and fitted into the groove portion 321, or as in the modification 5*a*, the buffer member 4*b* may be formed by filling and solidifying a liquid resin.

In the present modification 5 *b*, in addition to the same effects as those of the above embodiment, since the part of the buffer member 4*b* becomes an engaged state in the groove portion 321, fluorine-based resins having weak adhesion can also be used.

Further, even when other materials are used, since the buffer member 4*b* is held by the groove portion 321 even when the adhesion is lost due to deterioration by the long use, it will never drop into the combustion chamber 60.

Modifications regarding heat value differences will be described with reference to FIG. 7 and FIG. 8.

Figure 7:
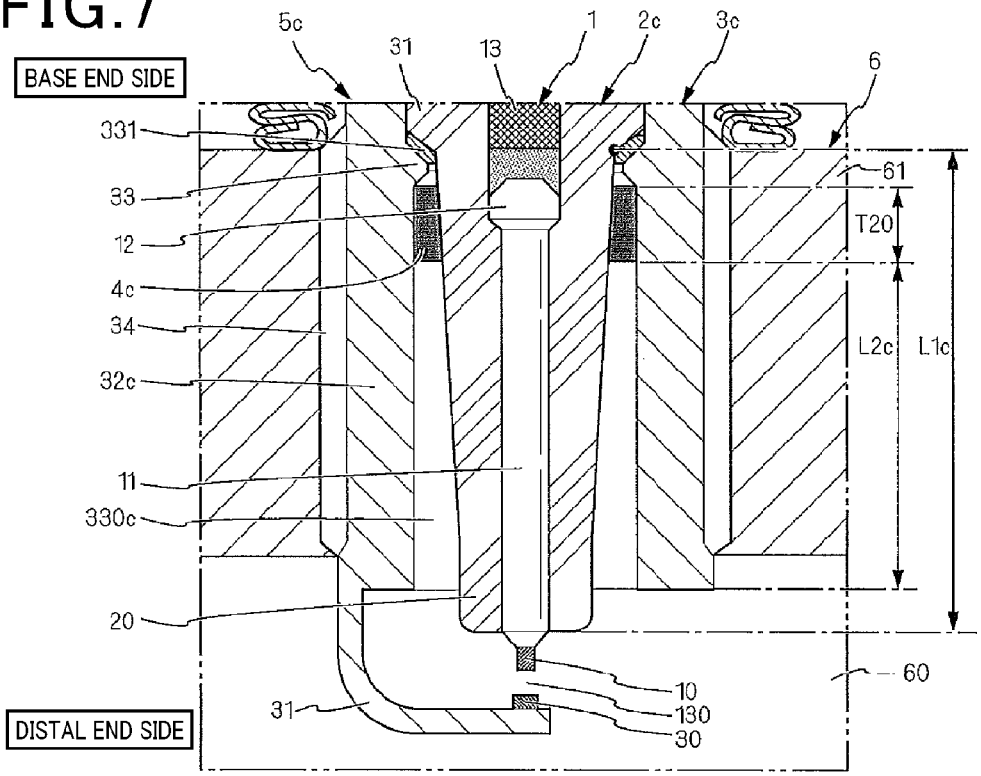
FIG. 7 shows an enlarged longitudinal sectional view of a principal part of a case where the present invention is applied to a low heat value (hot type) plug.

In a low heat value (hot type) plug 5*c* shown in FIG. 7, a surface area of a distal end side exposed part 20*c* exposed to hot combustion gas is large, thus it has a low heat value.

Even in this case, the same effect as the above embodiment can be demonstrated by disposing the buffer member 4 having a predetermined height T20 on the distal end side of the engaging part 33.

Since the buffer member 4 is made of resin, it has lower thermal conductivity than that in the insulator 2*c* or the housing 3*c*.

Therefore, although it is considered that there is a possibility that heat value becomes high due to the area of the distal end side exposed part 20*c* exposed to the gas pocket is reduced by disposing the buffer member 4, correspondingly, since an area of a side surface electrode 32*c* of the housing 3 exposed to the gas pocket 330*c* is also reduced, heat dissipation property is lowered, a reduction of heat receiving amount and a reduction of heat radiation amount are canceled to each other, thereby influence to the heat value is a little.

Figure 8:
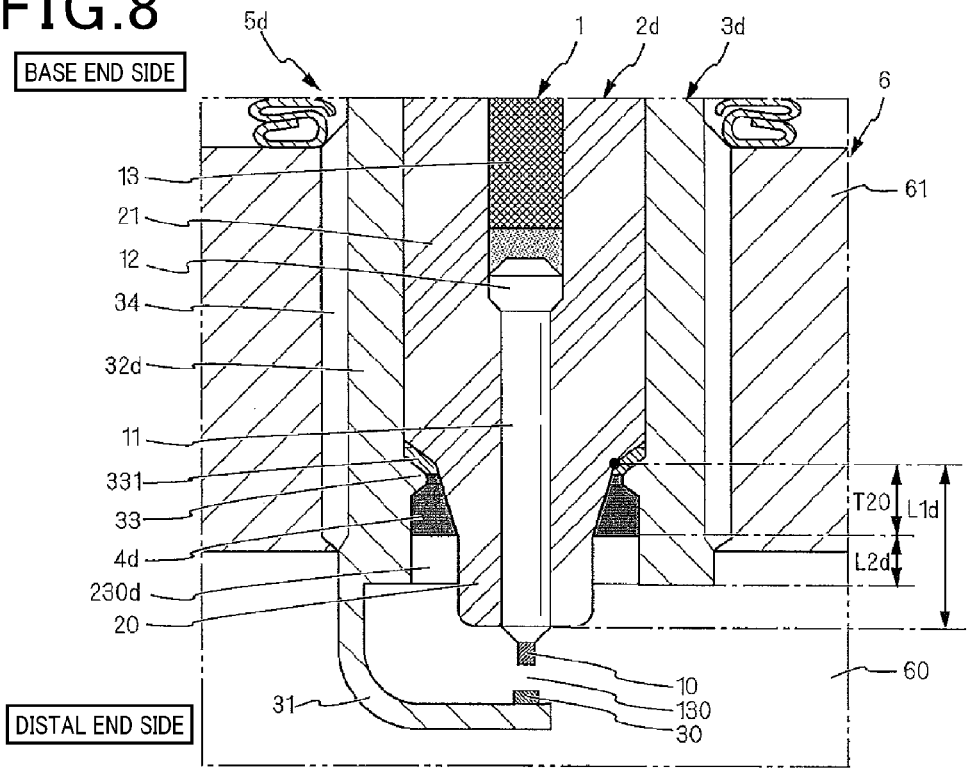
FIG. 8 shows an enlarged longitudinal sectional view of a principal part of a case where the present invention is applied to a high heat value (cold type) plug.

In a high heat value (cold type) plug 5*d* shown in FIG. 8, a surface area of a distal end side exposed part 20*d* exposed to hot combustion gas is small, thus it has a high heat value.

Even in this case, the same effect as the above embodiment can be demonstrated by disposing the buffer member 4 having a predetermined height T20 on the distal end side of the engaging part 33.

Incidentally, in consideration of smoldering, the length Ltd of the distal end side exposed part 20*d* exposed to the gas pocket 230 is the high heat value plug 5*d* is desirably to be 5 mm or more.

Modifications of a buffer member 4 will be described with reference to FIG. 9A, FIG. 9B, and FIG. 9C.

Figure 9A:
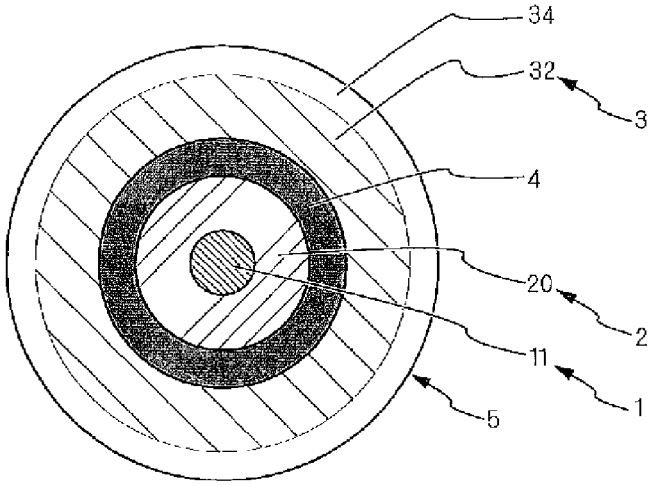
FIG. 9A shows an enlarged cross sectional view of a principal part of an outline of a ductile material provided as a vibration suppression means which is a principal part of the present invention.

Although an example has been described that the buffer member 4 is formed in the annular shape in the above embodiment as shown in FIG. 9A, since the buffer member 4 is sufficient to prevent the vibration in the vibrating direction from occurring at the distal end side of the engaging part 33 so as not to concentrate the stress, it is considered that it is not necessarily to dispose the buffer member 4 to cover the entire periphery of the outer peripheral surface of the distal exposed part 20.

Figure 9B:
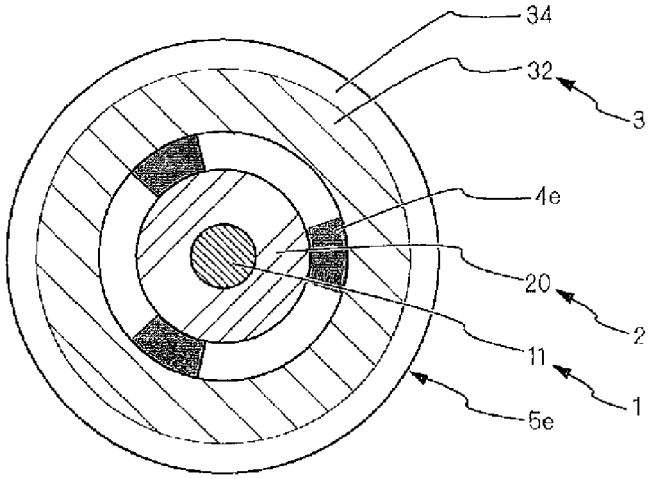
FIG. 9B shows an enlarged cross sectional view of a principal part of a modification of the ductile material.

As shown in FIG. 9B, when disposing a buffer member 4*e* formed in a sector-form section in at least three locations, the pressing force acts in a direction of suppressing the vibration of the distal end side exposed part 20 from occurring for any direction of the vibration, thereby the vibration is suppressed from occurring, and the effect of the present invention is demonstrated.

Figure 9C:
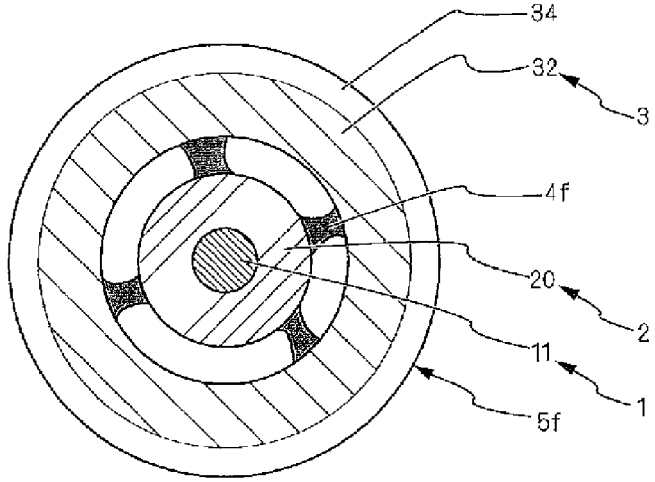
FIG. 9C shows an enlarged cross sectional view of a principal part of a modification of the ductile material.

Furthermore, as shown in FIG. 9C, even when disposed a plurality of buffer members 4*f* unevenly in the circumferential direction, the vibration is suppressed from occurring, and the effect of the present invention is demonstrated.

In particular, since the positioning is not necessary when forming the buffer member 4*f* according to the present invention in an existing spark plug, manufacturing becomes simple.

In the present embodiment, since a part of the distal exposed part 20 at the distal end side of the engaging part 33 is restrained by the buffer members 4*f*, the vibration in the radial direction is suppressed from occurring even the shock wave is applied thereto, thereby an occurrence of cracking on the diameter changing part 211 can be avoided due to the stress concentration.

Figure 10:
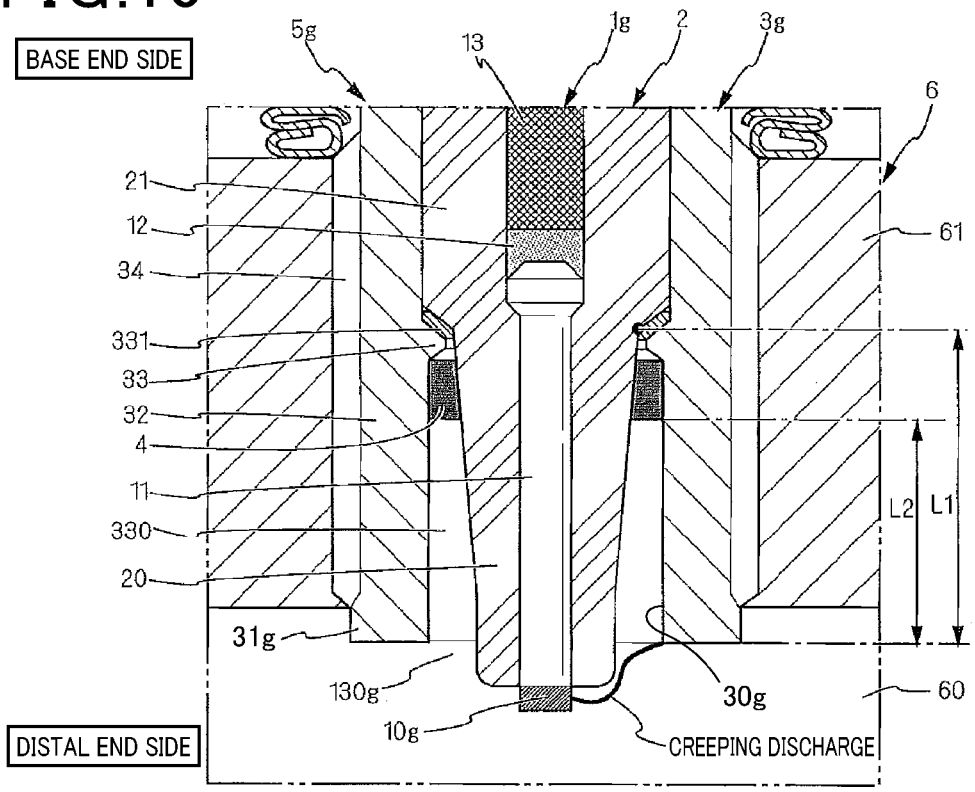
FIG. 10 shows a longitudinal sectional view of a principal part of an example which is applied to a creeping discharge plug as an ignition device in a second embodiment of the present invention.

A spark plug 5*g* for an internal combustion engine in a second embodiment of the present invention will be described with reference to FIG. 10.

In the above embodiment, structurally, the ground electrode 31 is formed so as to extend toward the center electrode discharge part 10 disposed at the distal end of the center electrode 1, the ground electrode discharge part 30 and the center electrode discharge part 10 are opposed to each other with the predetermined discharge space 130 therebetween, and the arc discharge is generated by applying a high voltage therebetween.

In the present embodiment, however, the present invention is applied to a so-called creeping discharge plug that has an annular ground electrode 31*g* formed on a distal end side of the housing 3*g*, an inner peripheral surface of the ground electrode 31*g* is configured to be a ground electrode discharge part 30*g*, and when a high voltage is applied between the ground electrode discharge part 30*g* and a side surface of a center electrode discharge part 10*g* exposed in the combustion chamber 60 from the distal end of the distal end side exposed part 20, a creeping arc discharge formed so as to crawl along a surface of the distal end side exposed part 20*g* is generated.

Even in the present embodiment, an annular buffer member 4 as a vibration suppression means made of a ductile material is disposed between the distal end side of the engaging part 33 and a position where a predetermined heat value adjustment length L1 can be ensured.

In the present embodiment, the same effect as the above embodiment can be expected. Further, the modifications described above for the buffer member can be employed suitably to the present embodiment.

Figure 11:
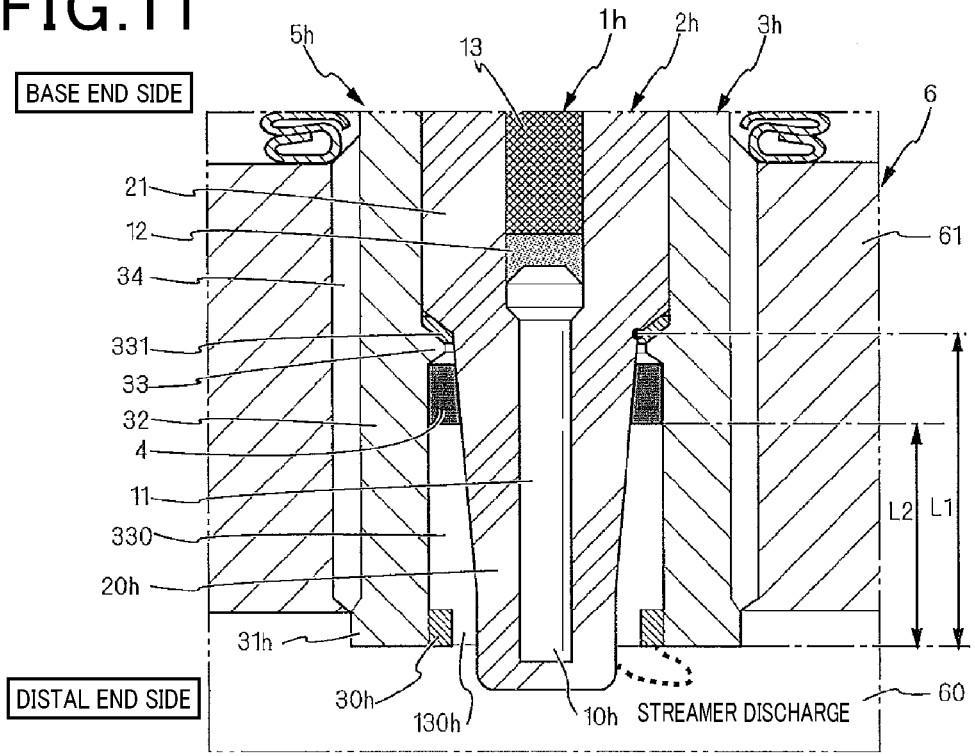
FIG. 11 shows a longitudinal sectional view of a principal part of an example which is applied to a barrier discharge plug as an ignition device in a third embodiment of the present invention.

A spark plug 5*h* for an internal combustion engine in a second embodiment of the present invention will be described with reference to FIG. 11.

In the above embodiment, an example of applying the present invention to a so-called spark discharge type spark plug that applies a DC voltage between the center electrode discharge part 10 which is disposed via the insulator 23 and the ground electrode discharge part 30 to generate arc discharge in the discharge space 130 for igniting the internal combustion engine 6 has been described. The spark plug 5*h* in the present embodiment, however, it is different in a point that the present invention is applied to a so-called barrier discharge type spark plug in which a distal end of the center electrode discharge part 10*h* is covered with a bottomed cylindrical insulator 2*h*, and an AC voltage with a predetermined frequency from a high frequency high voltage power source (not shown) is applied between the center electrode discharge part 10*h* and a ground electrode discharge part 30*h* to generate a streamer discharge in a discharge space 130*h* formed between a surface of a distal exposed part 20*h* and the ground electrode discharge part 30*h* for igniting the internal combustion engine 6.

The center electrode discharge part 10*h* disposed at a distal end of a center electrode 1*h* in the spark plug 5*h* is covered by the distal end side exposed part 20*h* formed in a bottomed cylindrical shape.

Further, a ground electrode 31*h* formed in an annular shape and facing the combustion chamber 60 is formed at a distal end of a housing 3*h* in the present embodiment, and further, the annular ground electrode discharge part 30*h* with a smaller diameter than the ground electrode 31*h* and projecting toward the center electrode discharge part 10 is formed on an inner circumferential surface of the ground electrode 31*h*.

Even in the present embodiment, an annular buffer member 4 as a vibration suppression means made of a ductile material is disposed between the distal end side of the engaging part 33 and a position where a predetermined heat value adjustment length L1 can be ensured.

In the present embodiment, the same effect as the above embodiment can be expected.

Further, the modifications described above for the buffer member 4 can be employed suitably to the present embodiment.

REFERENCE SIGNS LIST

1: center electrode
10: center electrode discharge part
11: center electrode high thermal conductive part
12, 14: conductive adhesive layers
13: noise-preventing resistor
15: center electrode axial intermediate shaft part
16: center electrode terminal part
2: insulator
20: distal end side exposed part
21: insulator enlarged diameter part
22: insulator head part
230: gas pocket
231: seal ring
232: powder sealing member
233: seal ring
3: housing (ground electrode)
30: ground electrode discharge part
31: ground electrode
32: lateral electrode
33: engaging part
34: threaded portion
35: crimping portion
36: hexagonal portion
4: buffer member
5: spark plug
6: internal combustion engine
60: combustion chamber
61: engine head

The invention claimed is:

1. A spark plug for an internal combustion engine used for igniting a mixture of fuel and air introduced into a combustion chamber of an internal combustion engine, the spark plug comprising:

at least a center electrode extending in a shaft-like shape, a cylindrical insulator supporting the center electrode, and a tubular housing accommodating and supporting the insulator; wherein:

a side of the spark plug to be attached to the internal combustion engine is referred to as a distal end side, and a side opposite in an axial direction is referred to as a base end side;

the insulator at least includes a distal end side exposed part exposed to the combustion chamber and an insulator enlarged diameter part of which a diameter of a part of a base end side of the distal end side exposed part is expanded radially outwards;

the housing includes a cylindrical lateral electrode facing the combustion chamber;

an engaging part of which a part of an inner peripheral surface of the lateral electrode projecting toward a center and contacts directly or indirectly with a distal end side of the insulator enlarged diameter part;

a crimping portion for pressing the insulator in an axial direction via a sealing member disposed on a base end side of the insulator enlarged diameter part;

a gas pocket of which a distal end side communicates with the combustion chamber is partitioned by a surface of the distal end side exposed part and the inner peripheral surface of the lateral electrode, and is closed by the engaging part and the enlarged diameter part;

a buffer member that restrains the distal end side exposed part by pressing a part of the distal end side exposed part toward the center and a part of the inner peripheral surface of the lateral electrode in a radial direction at a distal end side of the engaging part is disposed at a base end side of the gas pocket; and a groove portion is formed by depressing a part of the lateral electrode, and the buffer member is supported by the groove portion.

2. The spark plug for the internal combustion engine according to claim 1, wherein, the buffer member is made of a ductile material having Young's modulus of 0.1 to 20 GPa.

3. The spark plug for the internal combustion engine according to claim 1, wherein, the buffer member is made of a heat-resistant resin material with heat-resistant temperature of 100 degrees C. or more.

4. The spark plug for the internal combustion engine according to claim 2, wherein, the buffer member is made of a heat-resistant resin material with heat-resistant temperature of 100 degrees C. or more.

5. The spark plug for the internal combustion engine according to claim 1, wherein, the buffer member is made of a resin selected from any one of fluorine-based resins, epoxy resins, silicone resins, polyamides, or polyimides.

6. The spark plug for the internal combustion engine according to claim 2, wherein, the buffer member is made of a resin selected from any one of fluorine-based resins, epoxy resins, silicone resins, polyamides, or polyimides.

7. The spark plug for the internal combustion engine according to claim 3, wherein, the buffer member is made of a resin selected from any one of fluorine-based resins, epoxy resins, silicone resins, polyamides, or polyimides.

8. The spark plug for the internal combustion engine according to claim 4, wherein, the buffer member is made of a resin selected from any one of fluorine-based resins, epoxy resins, silicone resins, polyamides, or polyimides.

* * * * *